US005758525A

United States Patent [19]

Goldman

[11] Patent Number: 5,758,525

[45] Date of Patent: Jun. 2, 1998

[54] HIGH SECURITY KEY OPERATED LOCK

[75] Inventor: Ilan Goldman, Herzlia, Israel

[73] Assignee: Ilco Unican, Inc., Montreal, Canada

[21] Appl. No.: 705,833

[22] Filed: Aug. 30, 1996

[51] Int. Cl.[6] ..... E05B 21/00

[52] U.S. Cl. ..... 70/353; 70/404; 70/411

[58] Field of Search ..... 70/353–355, 190, 70/191, 403, 404, 407, 409, 411, 412, 383–385

[56] References Cited

U.S. PATENT DOCUMENTS

| | | | |
|---|---|---|---|
| 8,071 | 5/1851 | Yale, Jr. | 70/354 |
| 17,293 | 5/1857 | Perry | 70/54 |
| 370,183 | 9/1887 | Doremus | 70/354 |
| 374,784 | 12/1887 | Doremus | 70/354 |
| 940,300 | 11/1909 | Borland | 70/404 |
| 1,145,870 | 7/1915 | Marvel | 70/353 |
| 1,151,080 | 8/1915 | Borland | 70/355 |
| 1,287,089 | 12/1918 | Patterson | 70/404 X |
| 2,062,010 | 4/1936 | Neer | 70/412 X |
| 2,301,755 | 11/1942 | Seiffert | 70/355 |
| 3,668,909 | 6/1972 | Roberts | 70/411 |

FOREIGN PATENT DOCUMENTS

| | | | |
|---|---|---|---|
| 373172 | 10/1921 | Germany | 70/412 |
| 198932 | 10/1938 | Switzerland | 70/354 |
| 271865 | 2/1951 | Switzerland | 70/355 |
| 251106 | 4/1926 | United Kingdom | 70/353 |

*Primary Examiner*—Suzanne Dino Barrett
*Attorney, Agent, or Firm*—Hill & Simpson

[57] ABSTRACT

A lock and a key are provided wherein the key is used in conjunction with the lock. The key has a stop bit and a series of coding bits along its shank. The stop bit and each coding bit have a leading edge and a trailing edge to provide coding of the key and to form one side of a groove. The lock has a housing having a key-actuated cogwheel assembly. The cogwheels are registered with a keyhole and are spaced for engagement by the coding bits of the key. A driven cogwheel assembly has a series of cogwheels that mesh with a corresponding key-actuated cogwheel. A lock bolt is projected and retracted between two positions by a lock bolt actuating mechanism responding to position of the stop bit and coding bits.

13 Claims, 14 Drawing Sheets

HIGH SECURITY KEY OPERATED LOCK

FIELD OF THE INVENTION

The present invention relates to key-operated locks in general and in particular to high security, key-operated locks. A high security, key-operated lock is designed such that its key cannot be extracted in the lock's open state, namely, when the lock's lock bolt is in its retracted unlocking position.

BACKGROUND OF THE INVENTION

It is well-known that key-operated locks are easier and quicker to operate and offer higher security than dial combination locks in the sense that only an authorized key holder can open the lock.

Notwithstanding the above, a conventional key-operated lock suffers from the fact that it can be picked by "feeling" for the position in which its lock bolt can be slid from its projected locking position to its retracted unlocking position.

In addition, a conventional key-operated lock suffers from the disadvantage that its "combination" can only be changed by the replacement of its entire disk tumbler assembly.

SUMMARY OF THE INVENTION

It is an object of the present invention to provide a novel high security, key-operated lock.

It is another object of the present invention that the lock be highly resistant to lock-picking attempts.

It is yet another object of the present invention that the lock can be provided in a virgin state and initialized by an end-user.

It is a still further object of the present invention that the combination of the lock can be changed by an authorized key holder.

In accordance with the teachings of the present invention, there is provided a lock for use with a key having a stop bit and a series of radially projecting axially spaced coding bits along its shank, the stop bit and each coding bit having a leading edge and a trailing edge, the leading edges of the coding bits being staggered with respect to one another so as to provide for the coding of the key and the trailing edges of the stop bit and the coding bits being aligned so as to form one side of an axially extending groove, the lock comprising:

(a) a housing having a keyhole with an inwardly directed radial key guiding pin and a lock bolt aperture;

(b) a key-actuated cogwheel assembly having an axial rotary axis and comprising a series of cogwheels, each cogwheel having a central aperture in registration with the keyhole, each cogwheel having an inwardly directed radial key engagement projection and being axially spaced for engagement by the coding bits on insertion of the key into the housing;

(c) a driven cogwheel assembly having an axial rotary axis and comprising a series of cogwheels, each cogwheel having a slot and being axially spaced for meshing with a corresponding key-actuated cogwheel;

(d) a lock bolt reciprocable between a retracted position and a projected position relative to the housing, the retracted and projected positions respectively corresponding to open and locked states of the lock;

(e) a lock bolt actuating mechanism for reciprocating the lock bolt between its retracted and projected positions, the arrangement being such that:

(i) the key-actuated cogwheel assembly has a first operative state corresponding to the locked state of the lock attained when the trailing edge of the stop bit is stopped by the key guiding pin and each key-actuated cogwheel is urged by the trailing edge of its corresponding coding bit to its key insertion position in which its key engagement projection is in alignment with the key guiding pin so as to define an essentially continuous ward of the lock, thereby enabling insertion of the key into the housing and its extraction therefrom, and (ii) the key-actuated cogwheel assembly has a second operative state attained when the leading edge of the stop bit is stopped by the key guiding pin and each driven cogwheel is turned by its corresponding key-actuated cogwheel to its respective indexed position for effecting alignment of the slots so as to provide a lock bolt recess in registration with the lock bolt aperture, thereby enabling reciprocation of the lock bolt into and from the housing by the lock bolt actuating mechanism and inhibiting the extraction of the key from the housing.

In a preferred embodiment of the present invention, the guide pin projects further inward than the key-actuated cogwheels' engagement projections so as to inhibit turning of the key on its only partial insertion into the housing.

In a preferred embodiment of the present invention, the lock bolt is biased to its outermost projected state in the lock's locked state, thereby preventing interference with the turning of the driven cogwheel assembly on turning the key.

In a preferred embodiment of the present invention, lock bolt actuating mechanism is releasably stopped in a locking position by a stopping means to inhibit free movement of the lock bolt into the lock bolt recess when formed, thereby preventing the lock bolt from merely "falling into" the lock bolt recess as could occur, for example, if the lock were to be mounted such that the lock bolt would be vertically disposed.

In a preferred embodiment of the present invention, the lock bolt actuating mechanism is actuated by a second partial turn of the key on engagement thereby on an inward axial displacement of the key relative to the housing employed, on the one hand, to disengage the key from the key-actuated cogwheel assembly which must be maintained in its second operative state and, on the other hand, to release the stopping means stopping the lock bolt actuating mechanism in its locking position. The stopping means is preferably spring loaded so as to bias the key outward with respect to the housing in the key-actuated cogwheel assembly's second operative state.

Thus, the key has a guide structure which operates with the housing's key guiding pin such that a "full" turn of the key is a two-step operation in which one step effects the transition of the key-actuated assembly between its first operative state and its second operative state and the other step effects the reciprocation of the lock bolt between its retracted opening position and its projected locking position. Typically, the "full" turn of the key equals about a ¾ turn of which the step effecting the transition of the key-actuated assembly takes up about a ⅝ turn and the step effecting the reciprocation of the lock bolt takes up about a ⅛ turn.

In a preferred embodiment of the present invention, the lock bolt actuating mechanism is coupled to the lock bolt via a resiliently flexible coupling.

In a preferred embodiment of the invention, the lock further comprises an anti-lock picking mechanism including a first member integrally formed with a second member. The first member is biased against the cogwheels of the key actuated cogwheel assembly so as to ride on the periphery thereof, thereby performing a cyclic "in/out" motion relative to its rotary axis as it tracks the contour of cogs and troughs between adjacent cogs during the turning of its cogwheels and the second member having a portion in proximity to a trailing portion of the lock bolt, the portion being biased to a first operative position enabling the retraction of the lock bolt in the lock bolt recess when formed and having a second operative position inhibiting the retraction of the lock bolt into the lock bolt recess when formed.

The driven cogwheel assembly is preferably laterally displaceable relative to the key actuated cogwheel assembly which is permanently mounted relative to the housing so as to be disengageable therefrom for enabling the re-initialization of the lock with the combination of a new key.

Additional features and advantages of the present invention are described in, and will be apparent from, the detailed description of the presently preferred embodiments and from the drawings.

BRIEF DESCRIPTION OF THE DRAWINGS

The present invention will now be further illustrated in the following non-limiting specific embodiment with reference to the annexed drawings in which.

DETAILED DESCRIPTION OF THE PRESENTLY PREFERRED EMBODIMENTS

Figure 1:
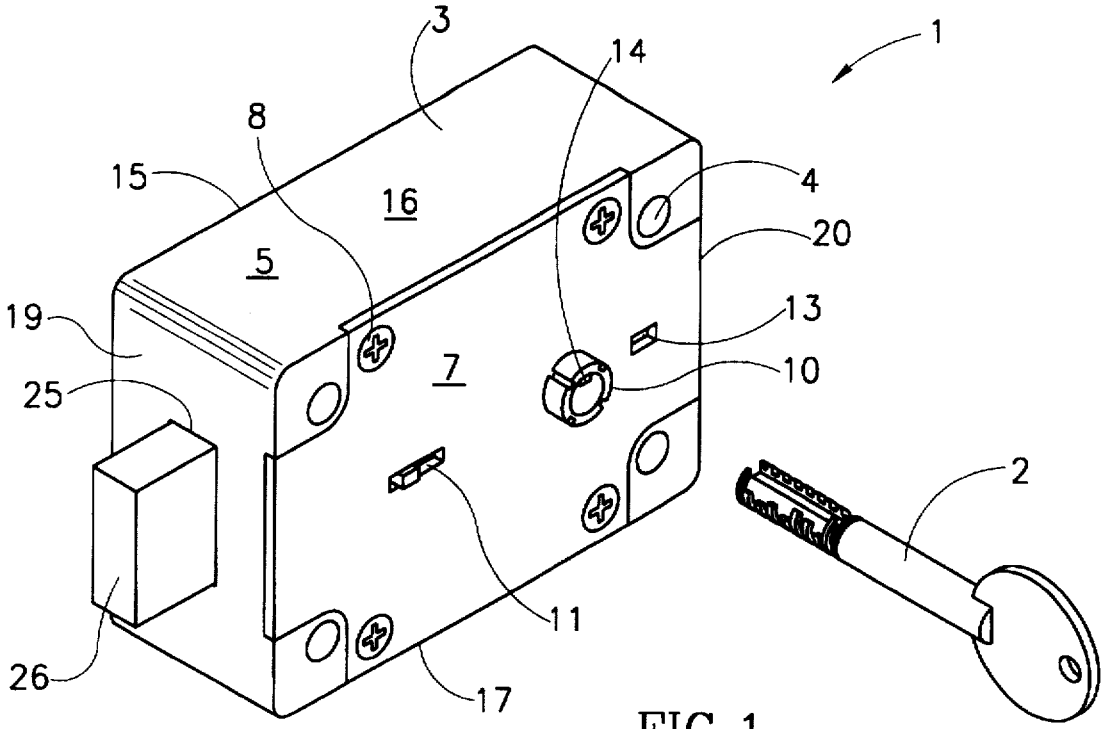
FIG. 1 illustrates a front perspective view of a high security, key-operated lock in accordance with the preferred embodiment of the invention.
Figure 2:
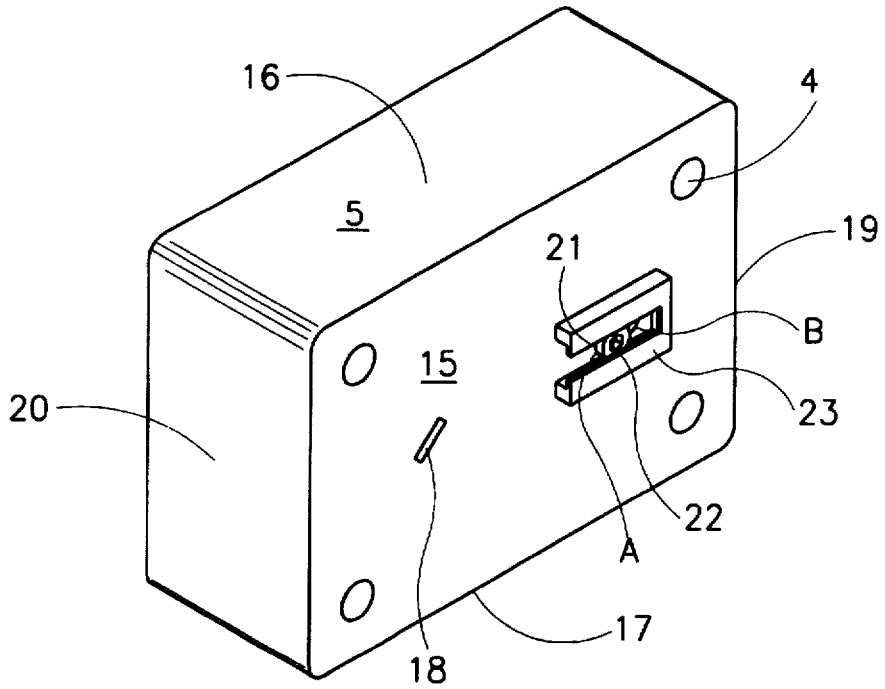
FIG. 2 is a rear perspective view of the lock of FIG. 1.

With reference now to the drawings, FIGS. 1 and 2 show a high security, key-operated lock, generally designated 1 and a key 2 having an axial rotary axis about which a clockwise turn opens the lock 1 and about which a counter clockwise turn locks the lock 1.

The lock 1 includes a housing 3 having through bores 4 enabling the attachment of the housing 3 to a fixture. The housing 3 includes a main block 5 and a cover plate 7 for attachment to the main block 5 by means of screws 8 received by tapped bores 9 (see FIG. 5) at the corners of the main block 5. The cover plate 7 includes a keyhole 10 and two slots 11 and 13 whose function will be described hereinbelow. The keyhole 10 is provided with an inwardly directed key guiding pin 14 acting as the first part of the ward of the lock 1. The key guiding pin 14 guides the key 2 through a two-step opening and locking procedure and will be described hereinbelow in greater detail.

The main block 5 includes a rear wall 15, long side walls 16 and 17 and short side walls 19 and 20. The rear wall 15 is provided with an inclined rectangular slot 18 whose function is explained hereinbelow and a contoured slot 21 enabling two positions of a screw 22 having a first position denoted A for the normal operation of the lock 1 and a second position denoted B required during a re-coding procedure of the lock 1 in a manner to be described hereinbelow in greater detail with reference to FIG. 11. The rear wall 15 is also provided with a guard 23 for retaining the screw 22 as it is released and displaced between the two positions during the re-coding procedure. The side wall 19 is prepared with a lock bolt aperture 25 through which reciprocates a lock bolt 26 under the action of a key actuated lock bolt actuating mechanism 27 to be described hereinbelow in greater detail. The lock bolt 26 is shown in its projected position, corresponding to a locked state of the lock 1, as opposed to its retracted position, corresponding to an open state of the lock 1.

Figure 3A:
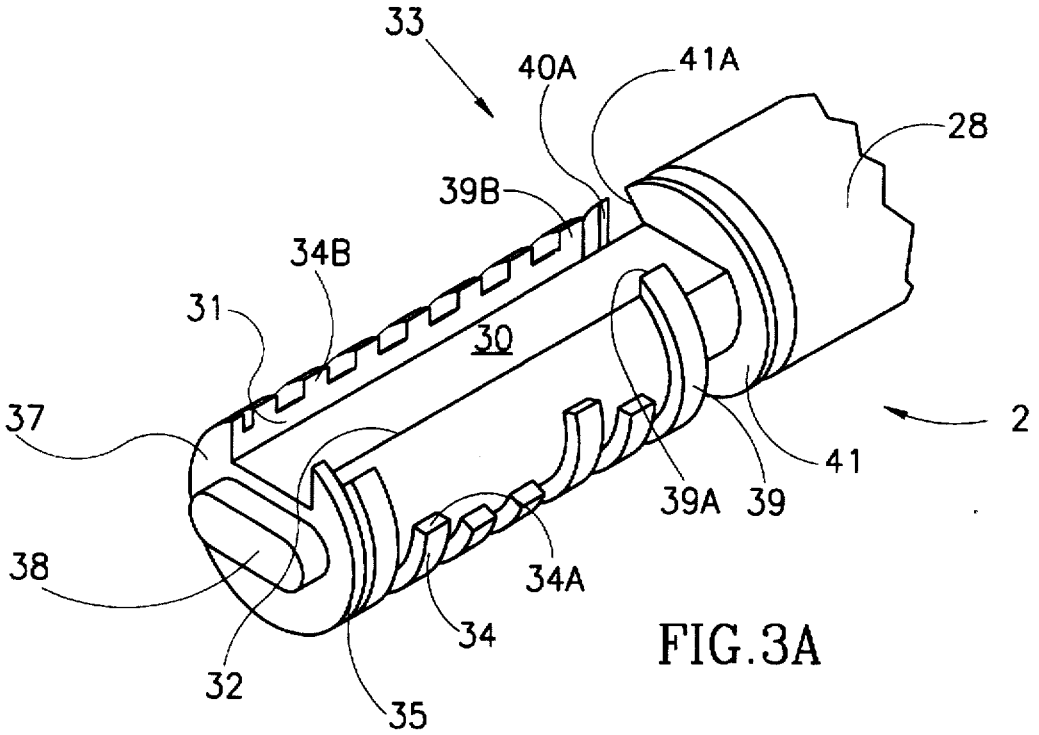
FIGS. 3A and 3B are close-up isometric views of the leading portion of the key associated with the lock of FIG. 1.
Figure 3B:
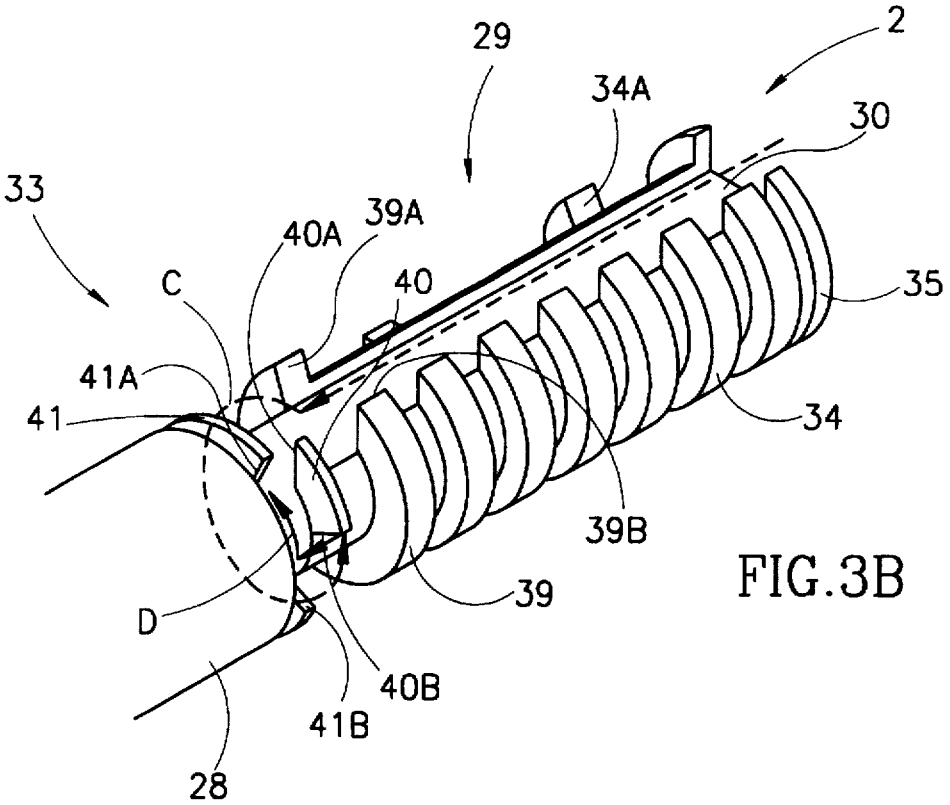
Figure 4:
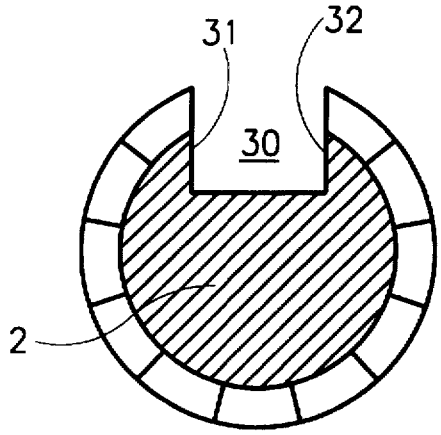
FIG. 4 is a schematic cross-sectional view of the key of FIG. 3.

Turning now to FIGS. 3A, 3B and 4, the key 2 has a generally cylindrical cross-section split between a trailing portion 28 and a leading portion 29 having an axially extending groove 30 having a depth corresponding to the height of the key guiding pin 14 and a first side wall 31 and a second side wall 32, such that the insertion of the key 2 into the housing 3 is enabled on registration of the groove 30 with the ward of the lock 1 and the key 2 can not be turned on its only partial insertion by virtue of the key guiding pin 14 abutting against one of the side walls 31 and 32.

The leading portion 28 includes a three piece guide structure 33 which co-operates with the key guiding pin 14 to implement a two-step operation for the opening and locking of the lock 1. Six radially projecting axially spaced coding bits 34, a centering bit 35 for ensuring the centering of the key 2 in the housing 3 and a leading end face 37 are provided with a rectangular projection 38 for engaging an element of the key-actuated lock bolt actuating mechanism 27. The axial spacing between adjacent coding bits 34 is greater than the axial length of the coding bits 34 such that the coding bits 34 can disengage from their respective cogwheels of a key-actuated cogwheel assembly on a suitable inward axial displacement for reasons to be explained hereinbelow.

The three piece guide structure 33 includes a leading bit 39 having a leading edge 39A and a trailing edge 39B in alignment with the side walls 31 and 32 of the groove 30, respectively. An intermediate stop bit 40 has a first stopping edge 40A in alignment with the side wall 31 of the groove 30 and a second stopping edge 40B at about three o'clock relative to the groove 30 and a trailing bit 41 having a first stopping edge 41A in alignment with the side wall 31 of the groove 30 and a second stopping edge at about five o'clock relative to the groove 30.

As such, the guide structure 33 includes a first long channel denoted C of about a ⅝ turn defined by the opposing rear wall of the leading bit 39 and front wall of the trailing bit 41 and the opposing first stopping edge and the second stopping edge 40B and a second short channel D of about a ⅛ turn defined by the opposing rear wall of the intermediate stop bit 40 and the front wall of the trailing portion 28 and the opposing first stopping edge 41A and the second stopping edge 41B.

Each of the coding bits 34 has a leading edge 34A and a trailing edge 34B. The leading edges 34A of the coding bits 34 are staggered at various angular positions providing for the coding of the key while the trailing edges 34B of the coding bits 34 are aligned with the side wall 31 of the groove 30. The total number of combinations of the lock 1 is defined, on the one hand, by the number of coding bits 34 and, on the other hand, the possible number of angular positions at which the leading edge 34A of each of the coding bits 34 can be set. Typically, as shown in this case, the leading edge 34A can assume one of eleven angular positions, thereby rendering a total number of $11^6$ combinations for the key 2 and, therefore, for the lock 1.

Figure 5:
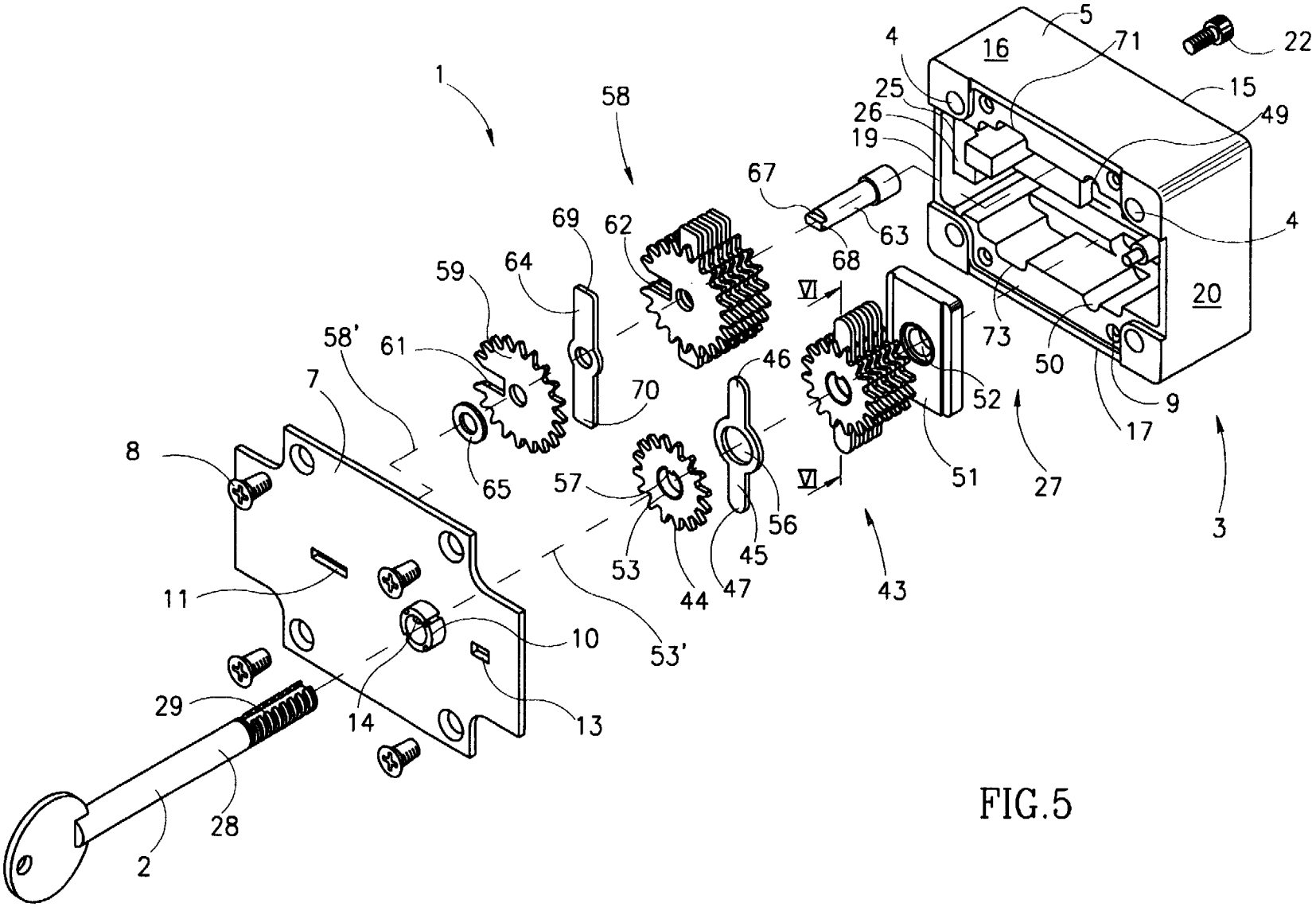
FIG. 5 is an exploded isometric view of the lock of FIG. 1.

Turning now to FIG. 5, the housing 3 houses a key-actuated cogwheel assembly, generally designated 43, having an axial rotary axis 43' and including six cogwheels 44 axially spaced by spacer elements 45 in accordance with the axial spacing of the key's coding bits 34. The spacer elements 45 have ends 46 and 47 fitting snugly into recesses 49 and 50 provided in the long side walls 16 and 17, respectively. A plate 51 has a central aperture 52 for receiving the key's centering bit 35 so as to center the key 2 on its insertion into the housing 3.

The cogwheels 44 are annular, each having a central aperture 53 having an axially projecting rim 55 for insertion in a central aperture 56 of a spacer element 45 (best seen in FIG. 6) and an inwardly directed radial engagement projection 57. The cogwheels 44 are each independently rotatable by its corresponding coding bit 34 between a key insertion position defined as when its engagement projection 57 is in alignment with the key guiding pin 14 and an indexed position coded for by its corresponding coding bit 34.

The cogwheel assembly 43 has a first operative state corresponding to the locked state of the lock and attained when the stop bit's trailing edge 40A is stopped by the key guiding pin 14, and each key actuated cogwheel 44 is urged by the trailing edge of its corresponding coding bit 34 to its key insertion position in which its engagement projection is in alignment with the key guiding pin 14 so as to define an essentially continuous ward of the lock. The cogwheel assembly's first operative state thereby enables insertion of the key 2 into the housing 3 and extraction therefrom.

The cogwheel assembly 43 has a second operative position arrived at from the first operative position by the clockwise turn of the key 2 corresponding to the passage of the key guiding pin 14 along the long channel C wherein each cogwheel 44 is turned to its respective coded for position. The cogwheel assembly's second operative state thereby inhibits the extraction of the key 2 from the housing 3 as is the norm for high security, key-operated locks.

The housing 3 also houses a second cogwheel assembly, generally designated 58, having an axial rotary axis 58 and which includes cogwheels 59 axially spaced so as to mesh with corresponding key-actuated cogwheels 44. Each cogwheel 59 has a slot 61 extending radially inward from its periphery. All of the slots 61 are in alignment in the second operative state of the cogwheel assembly 43 so as to define a lock bolt recess 62 in registration with the lock bolt aperture 25 for receiving a trailing portion of the lock bolt 26 when reciprocated to its retracted position via the lock bolt actuating mechanism 27.

The cogwheels 59 are rotatably mounted on a spindle 63 also carrying spacer elements 64 and a washer 65. The spindle 63 is mounted on the screw 22 and has a leading end 67 with a generally rectangular projection 68 which fits into the slot 11 in the cover plate 7. The ends 69 and 70 of the spacer elements 64 fit into recesses 71 and 73 in the side walls 16 and 17 of the main block 5, respectively. However, unlike the ends 46 and 47 of the spacer elements 45 which fit snugly within the recesses 49 and 50, respectively, the recesses 71 and 73 are designed such that the entire cogwheel assembly 58 can be laterally displaced from position A to the position B, thereby disengaging, the cogwheel assembly 58 from the cogwheel assembly 43 for enabling re-initialization of the lock 1 with a new combination.

Figure 7:
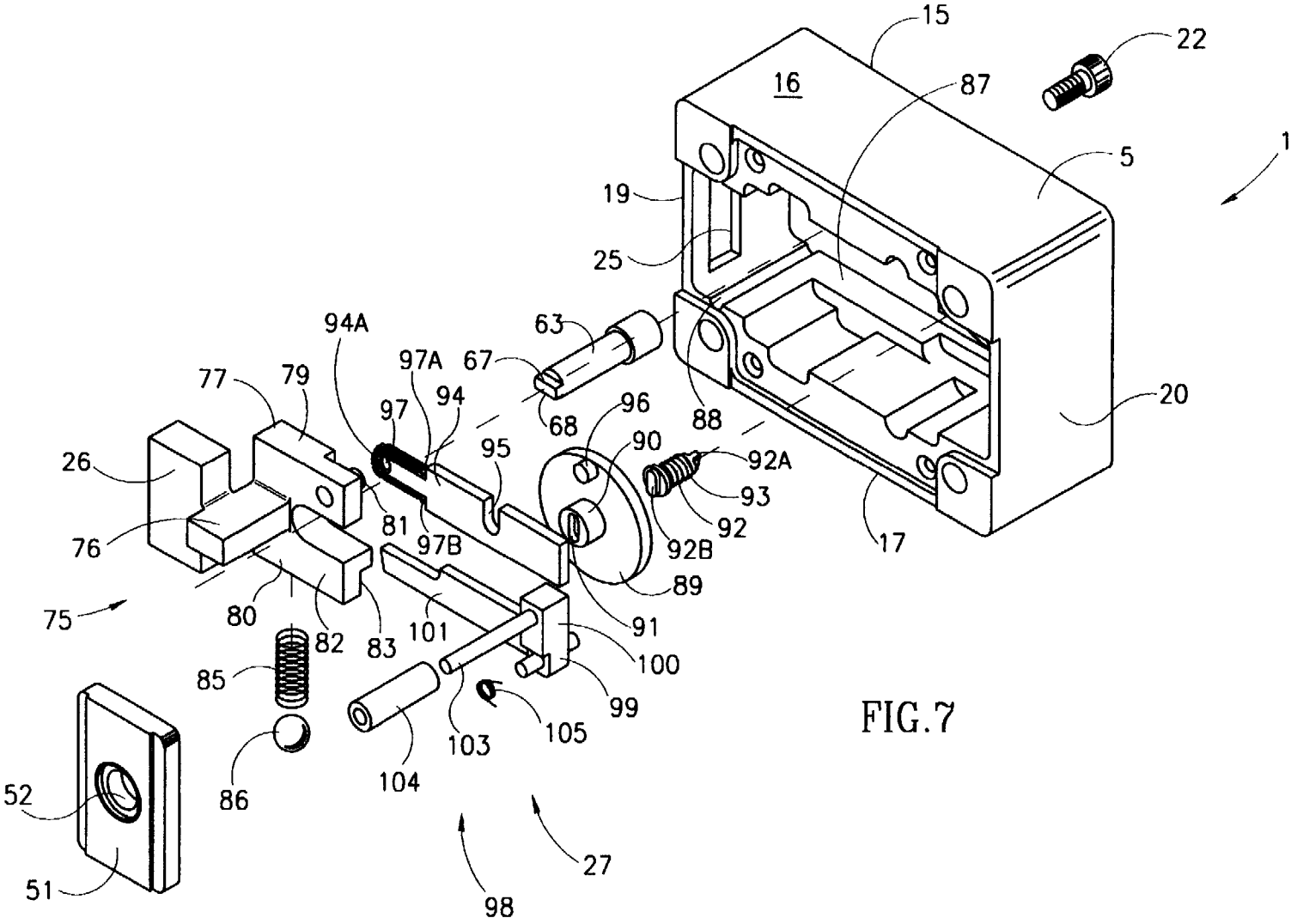
FIG. 7 is an exploded isometric view of the lock bolt actuating mechanism of the lock of FIG. 1.
Figure 8:
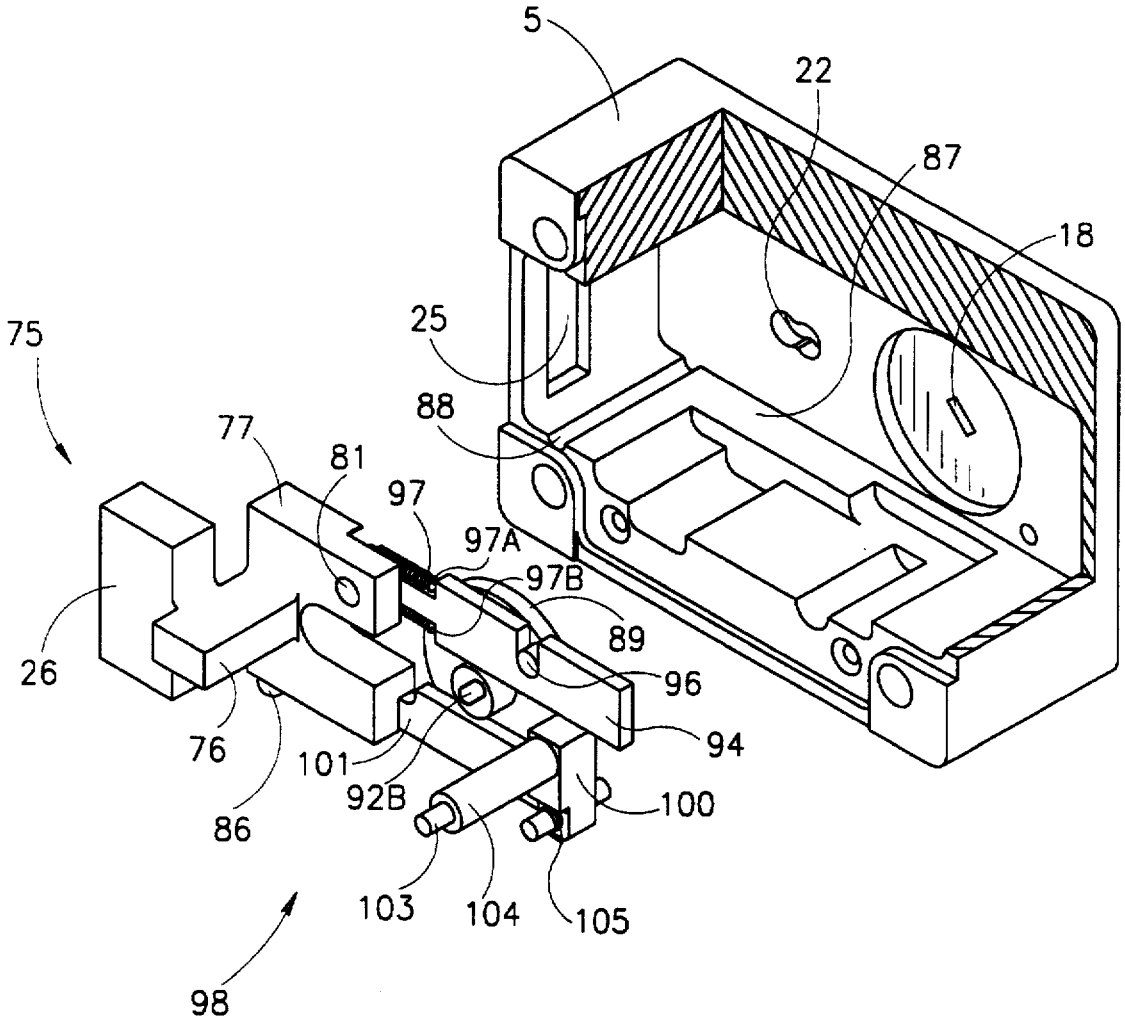
FIG. 8 illustrates the assembled lock bolt actuating mechanism separated from the main block of the lock of FIG. 1.

Turning now to FIGS. 7 and 8, the lock bolt actuating mechanism 27 includes a lock bolt block 75 with a leading portion in the form of the lock bolt 26, an intermediate neck portion 76 and a trailing bifurcated portion 77 with an upper leg 79 and a lower leg 80 spaced so as to slidingly receive the spindle 63 therebetween. The upper leg 79 has a recessed trailing free end with a circular projection 81, and the lower leg 80 has a trailing portion 82 with an elongated recess 83, the functions of which will be explained hereinbelow.

The intermediate neck portion 76 includes a bore (not shown) for receiving a spring 85 and an upper part of a rolling element 86 having a first raised position along a wall 87 in the lock's open state and a second lower position in a channel 88 adjacent to the side wall 19 in which it is biased by the spring 85 in the lock's locked state. Thus, the rolling element 86 ensures that the lock bolt 26 is biased in its outermost projected position in the lock's locked state so as not to interfere with the rotation of the cogwheels 59.

The lock bolt actuating mechanism 27 further includes a key actuated rotatable disk 89 having a protruding tubular boss 90 formed with a through going slot 91. The disk 89 is disposed such that its axial rotary axis is coincident with the key actuated cogwheel assembly's axial rotary axis 43'. The disk 89 is mounted on a double ended stopping pin 92 having a first rectangular projection 92A received in the slot 18 and a second rectangular projection 92B received in the slot 91 and is provided with a spring 93 along its length. The pin 92 constitutes a stopping means for stopping the lock bolt actuating mechanism 27 in its locking position, namely, when the lock bolt 26 is in its projected position. In the normal state of the lock 1, the outer surface of projection 92A lies flush with the outer surface of the rear wall 15.

The key 2 engages the rotatable disk 89 by means of the projection 38 snugly received by the slot 91 on the key's inward axial displacement. The user is required to push the key 2 so as to axially displace the pin 92. Thus, on the axial displacement of the pin 92, the spring 93 is compressed, and the projection 92A extends beyond the rear wall's 15 outer surface. The projection 92B is disengaged from the slot 91, thereby freeing the rotatable disk 89 such that it can be turned in a clockwise direction to reciprocate the lock bolt 26 from its projected locking position to its retracted unlocking position when turning the key along the channel D. Against this, during the locking of the lock 1, the pin 92 biases the key 2 outward such that a counter clockwise turn of the key 2 can be achieved in a single continuous movement as the key guiding pin 14 passes from the short channel D to the long channel C.

The lock bolt actuating mechanism 27 still further includes an elongated control rod 94 with a concave leading end 94A for receiving the projection 81 of the lock bolt block 75 and a trailing end with a slot 95 for receiving a projection 96 deployed on the periphery of the rotatable disk 89. The lock bolt block 75 and the control rod 94 are coupled by a U-shaped spring 97 for reasons to be explained hereinbelow. The U-shaped spring 97 is stretched between oppositely directed pins 97A and 97B.

FIGS. 7 and 8 also depict an anti-lock picking mechanism 98 including, an L-shaped member 99 having a first leg 100 and a second leg 101. The L-shaped member 99 is pivotally mounted at the apex between its legs 100 and 101. The leg 101 is provided with a rod 103 extending substantially parallel to the axial rotary axis 43' and having its front end received by the cover's slot 13, the rod 103 carrying a rotatably mounted sleeve 104 thereon. The L-shaped member 99 is biased by a spring 105 such that the sleeve 104 is biased against the key actuated cogwheels 44 to ride on the periphery thereof. The sleeve 104 performs a cyclic "in/out" motion relative to their axial rotary axis 43' as it tracks the cogs and the troughs between adjacent cogs as individual cogwheels 44 are rotated by their respective coding bits 34. In turn, the cyclic "in/out" motion of the sleeve 104 is translated as an "up/down" motion of the leg's 101 leading end in which the sleeve's "in" position corresponds to the leg's leading end's "down" position and the sleeve's "out" position corresponds to the leg's leading end's "up" position.

As will become clear hereinbelow, the length of the leg 100 is such that even a slight inward displacement of the lock bolt 26 in the lock's locked state ensures that the leg 101 remains in its "down" position, thereby preventing the turning of the key-actuated cogwheels 44.

The anti-lock picking mechanism 98 does not interfere with the normal two-step locking and unlocking operation of the lock 1. On the first hand, during the transition of the cogwheel assembly 43 between its first operative state and its second operative state, the lock bolt 26 is in its projected locking position such that it does not hinder the leg's leading end's "up/down" motion caused by turning of the key-actuated cogwheels 44 and, on the other hand, the sleeve 104 is in its "in" position translating to the leg's leading end's "down" position in the key actuated cogwheel assembly's second operative state, thereby enabling retraction of the lock bolt 26 into the lock bolt recess 62 by virtue of the elongated recess 83 receiving the leg 101 therein.

Figure 6:
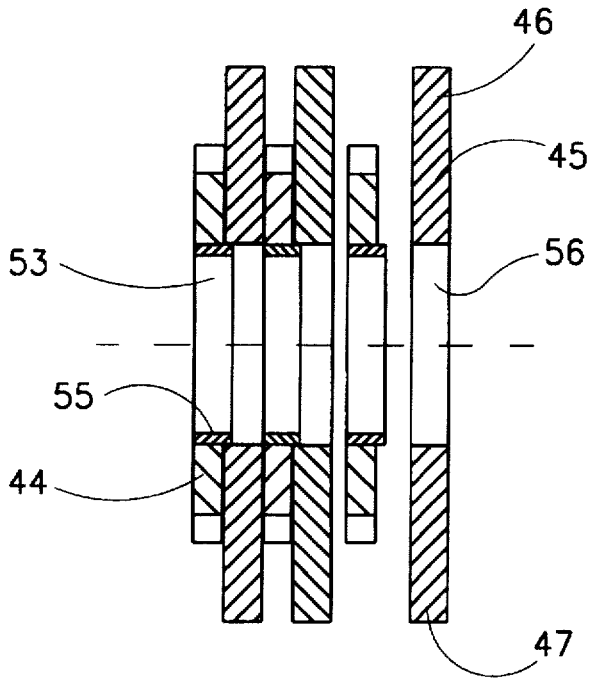
FIG. 6 is a longitudinal cross-sectional view through the key-actuated assembly of the lock of FIG. 1 along line VI—VI in FIG. 5.
Figure 9A:
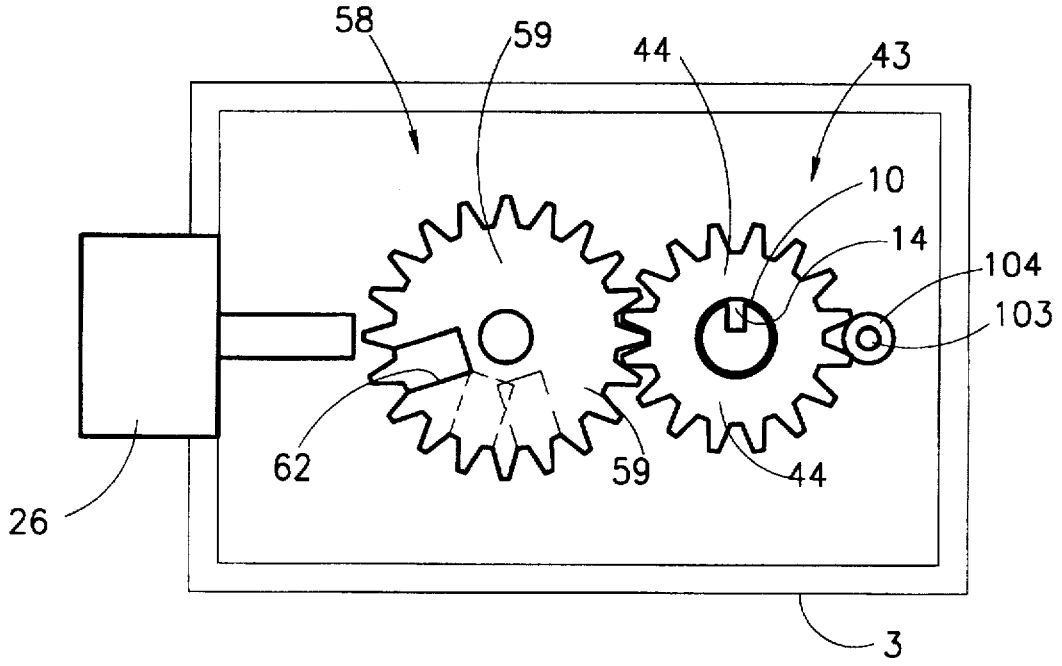
FIG. 9A illustrates the lock in its locked stated and the key-actuated cogwheel assembly in its first operative state enabling the insertion of a key into the lock during a sequence of operations for opening a lock having three cogwheels in each cogwheel assembly.
Figure 9B:
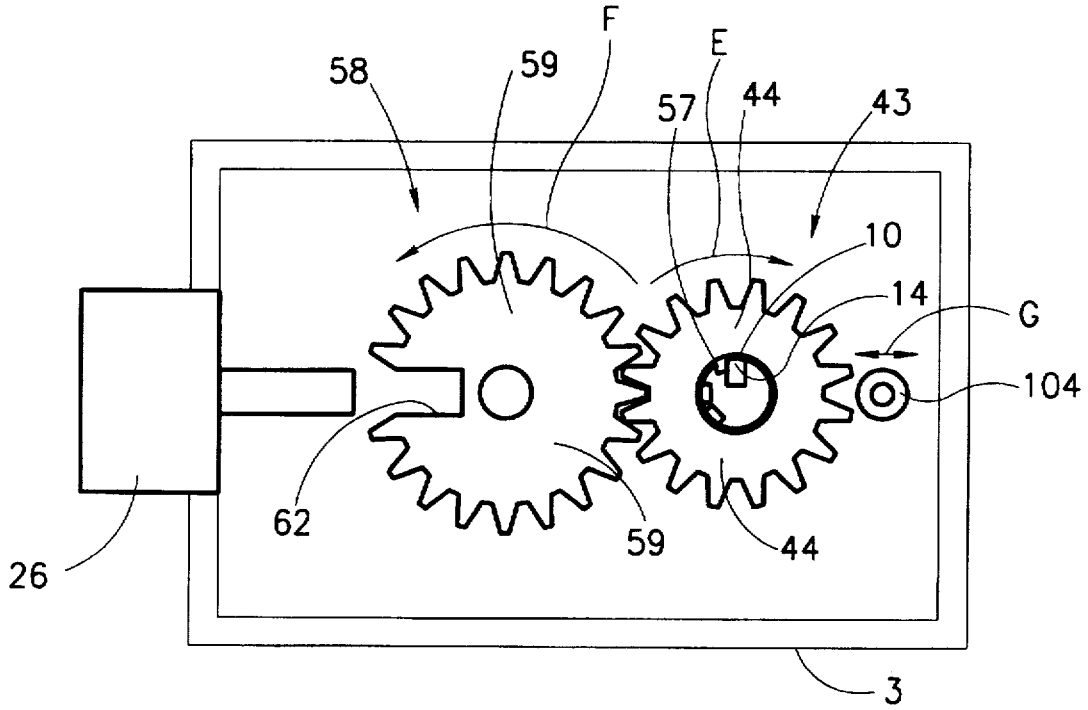
FIG. 9B illustrates the key-actuated cogwheel assembly in its second operative state thereby providing a lock bolt recess for the retraction of the lock bolt thereinto during a sequence of operations for opening a lock having three cogwheels in each cogwheel assembly.
Figure 9C:
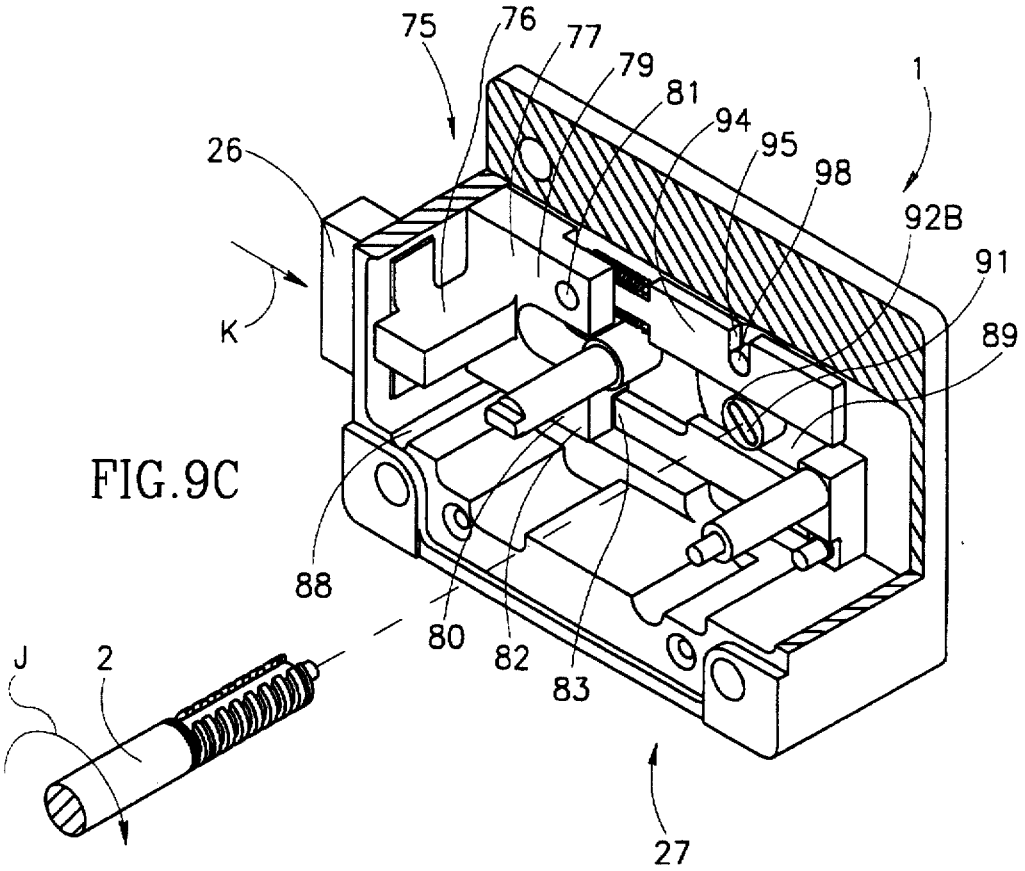
FIG. 9C illustrates the key-actuated operation for driving the lock bolt into the lock bolt recess from its projected locking position to its retracted unlocking position during a sequence of operations for opening a lock having three cogwheels in each cogwheel assembly.
Figure 9D:
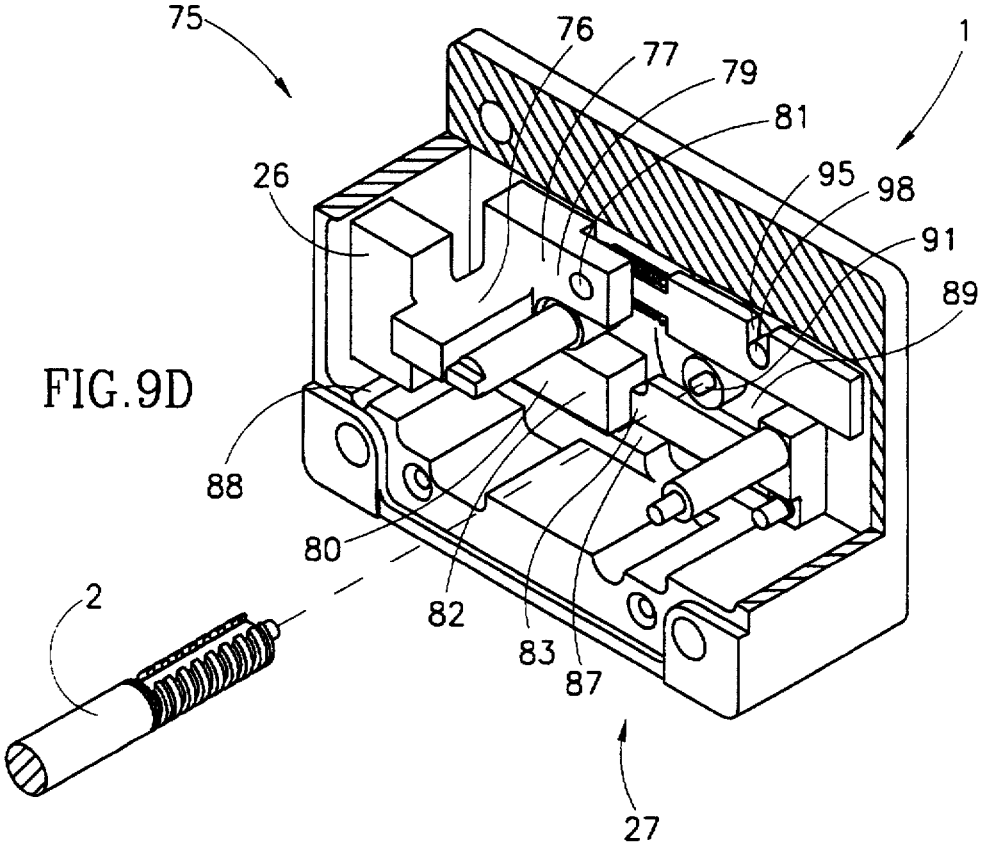
FIG. 9D illustrates the lock in its open state, namely the lock bolt having been retracted into the lock bolt recess during a sequence of operations for opening a lock having three cogwheels in each cogwheel assembly.
Figure 9E:
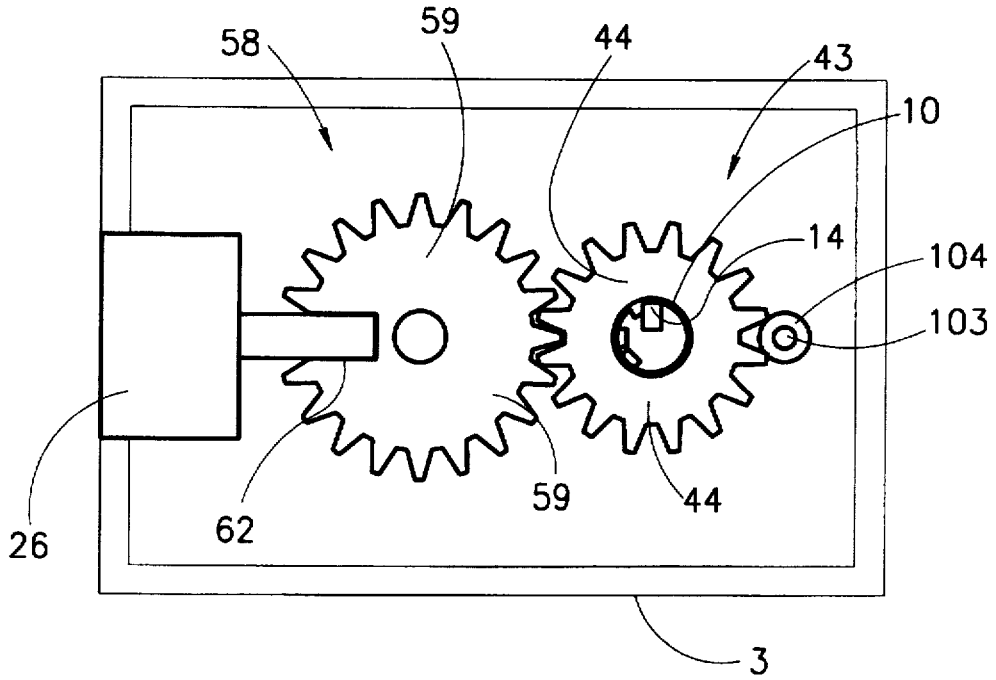
FIG. 9E illustrates the lock in its open state, namely, the lock bolt having been retracted into the lock bolt recess.

The operation of the lock 1 is now described with reference to the two-step unlocking procedure, namely, the retraction of the lock bolt 26 from its projected, locking position (FIGS. 9A–9C) to its retracted unlocking position (FIGS. 9D and 9E). For the sake of clarity, in FIGS. 9A, 9B and 9E, the key actuated cogwheel assembly 43 and the driven cogwheel assembly 58 each have three cogwheels 44 and 59, respectively, rather than six cogwheels as depicted in FIGS. 5 and 6, and the lock bolt actuating mechanism 27 and the anti-lock picking mechanism 98 except for the rod 103 and the sleeve 104 have been removed.

Thus, as shown in FIGS. 9A–9C, the lock bolt 26 is in its projected position. The cogwheel assembly 43 is in its first operative state ready for the insertion of the key 2 into the housing 3, and the rolling element 86 is biased by the spring 85 into the channel 88 so as to ensure that the lock bolt 26 cannot interfere with the smooth turning of the cogwheels 59. The lock bolt actuating mechanism 27 is in its locked state by virtue of the projection 92B being received in the slot 91.

In the first instance, on registration of its groove 30 with the key guiding pin 14, the user inserts the key 2 into the housing 3 until it is stopped by the trailing bit's 41 front wall abutting against the key guiding pin 14. Then, as shown in FIG. 9B, the user turns the key in a clockwise direction indicated by the arrow E causing the passage of the key guiding bit 14 along its long channel C from the stopping edge 40A to the stopping edge 40B. In practice, on clockwise turning of the key 2, each engagement projection 57 is engaged by the leading edge 34A of its corresponding coding bit 34 such that each cogwheel 44 is independently rotated from its key insertion position to its indexed position. The clockwise turn of each cogwheel 44 effects a counter-clockwise turn of its corresponding driven cogwheel 59 as indicated by the arrow F such that, cogwheel by cogwheel, the cogwheels 59 are rotated until each slot 61 is aligned opposite the lock bolt aperture 25 so as to provide the lock bolt recess 62.

At the same time that the user is rotating the key clockwise, the user can identify that the rod's 103 front end reciprocates within the slot 13, as indicated by the double headed arrow G, which as described above is evidence of its freely cyclic "in/out"0 movement as the sleeve 104 rides on the outer periphery of the cogwheels 44 by virtue of the clearance between the trailing portion of the lower leg 83 and the end of the leg 101 which freely performs its corresponding cyclic "up/down" movement.

After forming the lock bolt recess 62, the user is prevented from further clockwise turning of the key 2 by the abutment of the stopping edge 40B against the key guiding pin 14. The user then pushes the key 2 axially inward so as to engage the lock bolt actuating mechanism 27 while releasing the same from the stopping action caused by the pin 92 and disengaging itself from the key actuated cogwheels 44 such that the key actuated cogwheel assembly 43 can remain in its second operative state for the second step of the opening procedure.

Then, as shown in FIG. 9C, the user turns the key 2 further clockwise as indicated by the arrow J corresponding to the passage of the key guiding bit 14 along the short channel D so as to actuate the lock bolt actuating mechanism 27 for retracting the lock bolt 26 into the housing 3 as indicated by the arrow K by means of the trailing portion of the lock bolt 26 being received in the lock bolt recess 62. The trailing portion 82 slides over the leading end of the leg 101, and the rolling element 86 (as shown in FIG. 8) is raised from the channel 88 onto the track portion 87 as shown in FIG. 9D.

As can be readily appreciated in FIG. 9E, by virtue of the fact that the key-actuated cogwheel assembly 43 is in its second operative position while the lock is in its open state, the user is unable to withdraw the key 2 from the lock 1.

The locking of the lock 1 and the extraction of the key 2 are achieved by a reverse procedure except that the key 2 is biased outward by the pin 92 during the transition from the short channel D to the long channel C during the counterclockwise turning of the key 2.

Figure 10A:
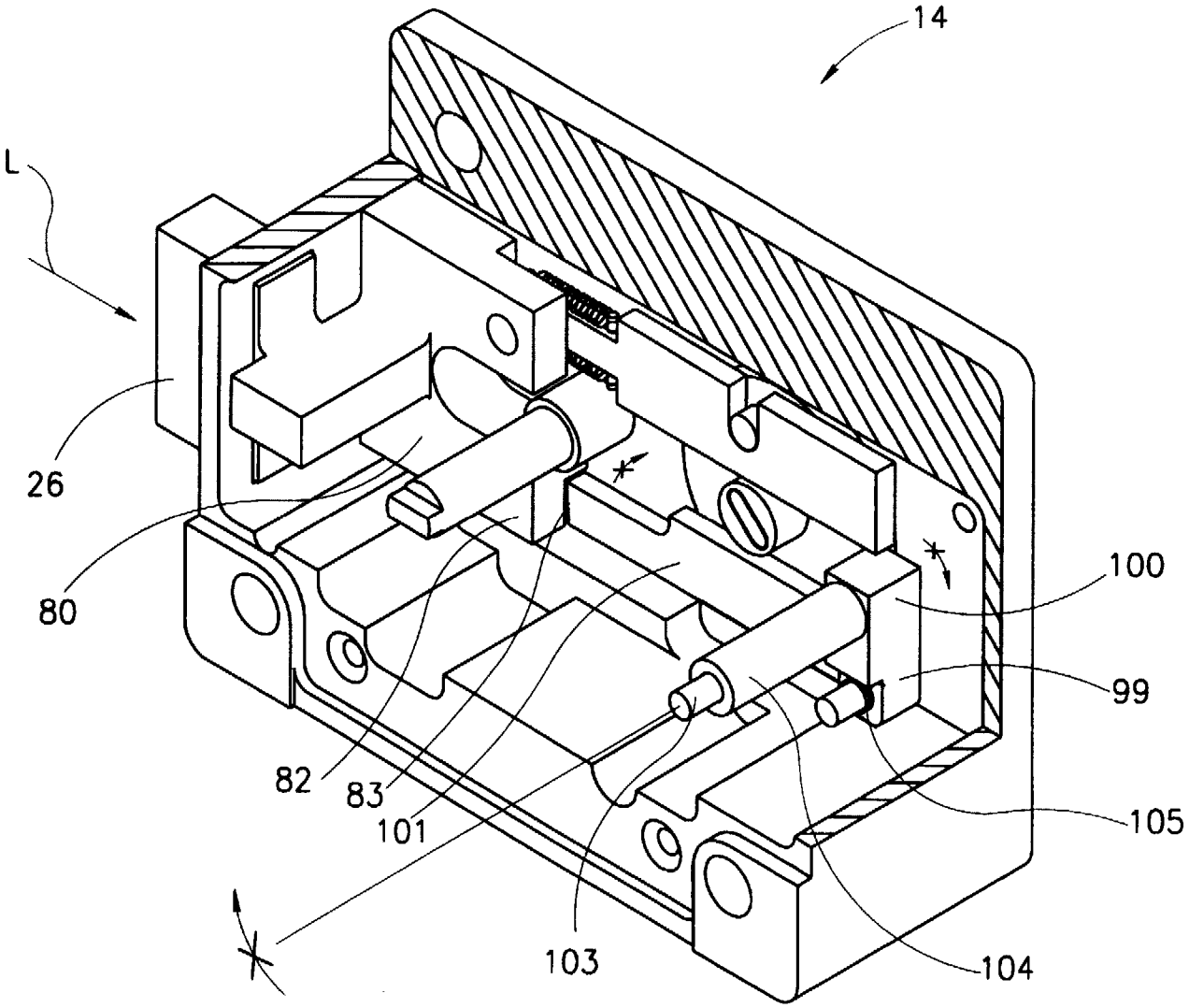
FIGS. 10A and 10B illustrate the operation of the anti-lock picking mechanism of the lock of FIG. 1 to thwart a lock picking attempt.
Figure 10B:
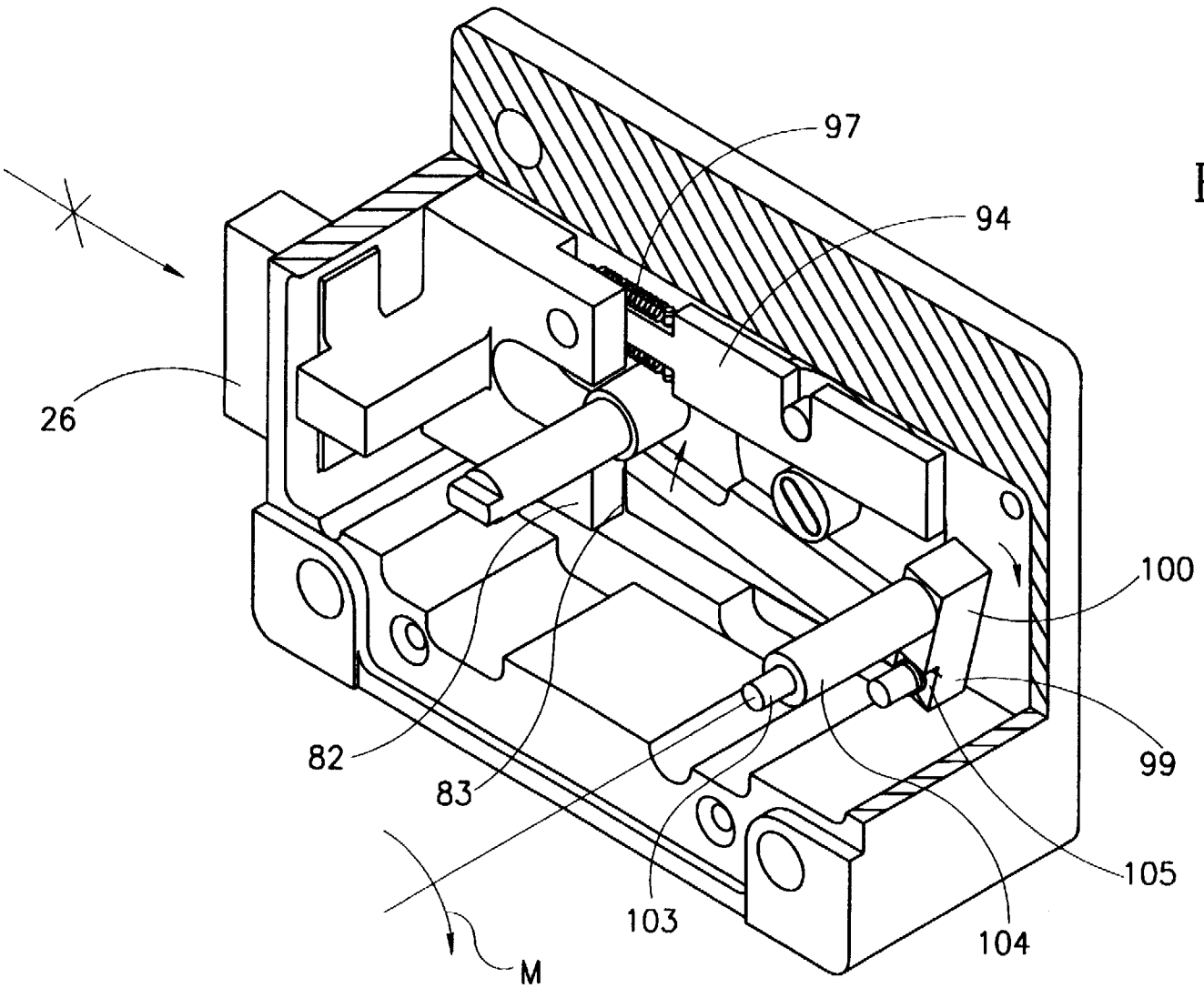

Turning now to FIGS. 10A and 10B, the operation of the anti-pick locking mechanism 98 is now described in the event of an attempted "feeling" for the indexed position of each of the cogwheels 59 so as to enable the eventual forming of the lock bolt recess 62 which, in turn, would enable the lock 1 to be opened. In the event that the lock 1 is not provided with the anti-lock picking mechanism 98, this could be achieved by a relatively simple procedure executed in the following manner.

First, a would-be lock picker inserts a tool into the lock's keyhole. The tool is adapted to apply an initial slight opening load on the control rod 95 such that the neck portion 76 bears against the cogwheels 59. In practice, the neck portion 76 only bears against the outermost projecting cogwheel 59'. Second, the would-be lock picker inserts a second tool into the lock's keyhole. This tool is adapted to rotate a selected cogwheel 43. Third, the would-be lock picker identifies the outermost projecting cogwheel 59' by rotating each of the cogwheels 43 in turn. The outermost cogwheel 59' is readily identifiable by a clicking noise as its cogs strike the neck portion 76. In contrast, the other cogwheels 59 would not sound a clicking noise as they are turned. Fourth, the would-be lock picker rotates the outermost projecting cogwheel 59, until its slot 61' is aligned with the lock bolt aperture 25. This position is detectable by means of a greater inward displacement of the lock bolt 26 in comparison to its inward displacement as it falls into a trough between adjacent cogs. Fifth, the would-be lock picker repeats the above steps for all of the subsequent outermost projecting cogwheels 59 so as to form the lock bolt aperture 62. And finally, the would-be lock picker opens the lock 1 by sliding the lock bolt 26 into the lock bolt recess 62 using the same first tool.

The presence of the anti-lock picking mechanism 98 considerably slows down the execution of the above-described sequence of steps by inhibiting the simultaneous application of an opening load to the control rod 94 and the turning of the cogwheels 43. This is because, as shown in FIG. 10A, the opening load on control rod 94, as indicated by the arrow L, causes the free trailing end of the lower leg 80 to overlie the leading end of the leg 101 of the L-shaped member 99, so as to inhibit the "up/down" movement of the leg 101 which, in turn, jams the turning of the cogwheels 44 by means of the sleeve 104 being jammed in a trough between adjacent cogs so as to inhibit any rotation.

While, as shown in FIG. 10B, any attempt of turning one of the cogwheels 44 as indicated by the arrow M causes the outward radial movement of the sleeve 104 relative to the axial rotary axis 43', the outward radial movement imparts an upward movement of the leading end of the leg 101. The leg 101 thereby acts as a restraining member to the lock bolt 26.

Finally, not only is the execution of the above sequence of steps to pick the lock 1 considerably slowed down, but, in addition, the lock 1 is made further pick-proof by the coupling 97 which, by its flexibility, prevents a would-be lock picker from ascertaining the indexed positions of each of the cogwheels 59, namely, when their slots 61 are in registration with the lock bolt aperture 25.

As mentioned earlier, the combination of the lock 1 can be re-initialized with a new key having a different combination than an old key which may, for example, have been copied. The sequence of operations for re-initialization of a lock's combination with a new key is now described with reference to FIGS. 11A–11D.

In FIGS. 11A–11D, in a similar fashion to FIG. 9A, the key-actuated cogwheel assembly 43 and the driven cogwheel assembly 58 each have three cogwheels 44 and 59, respectively, rather than six cogwheels as depicted in FIGS. 5 and 6. The lock bolt actuating mechanism 27 and the anti-lock picking mechanism 74, except for the rod 103 and the sleeve 104, have been removed from the figures for the sake of clarity and convenience.

Figure 11A:
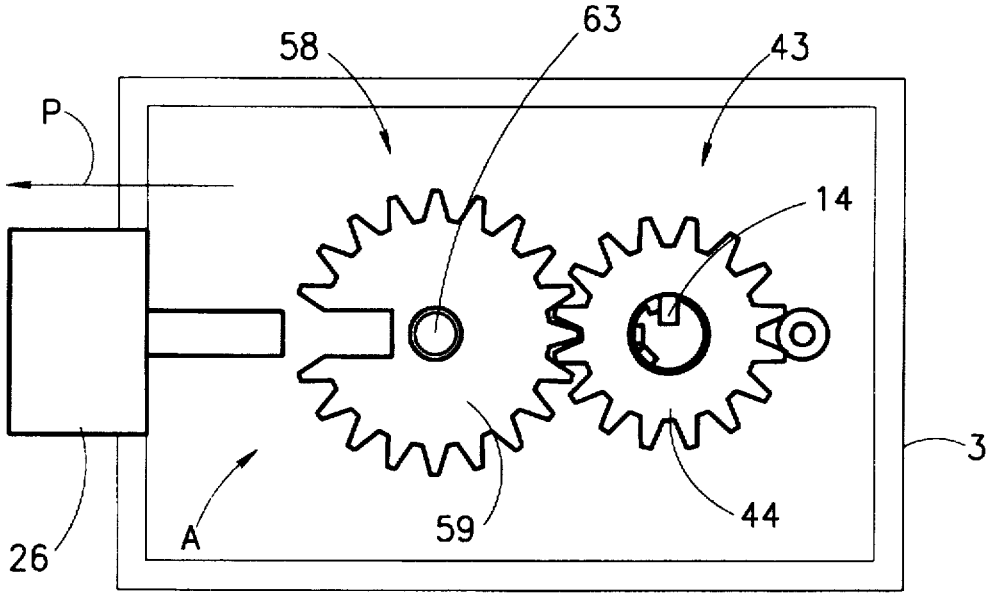
FIG. 11A illustrates the key-actuated assembly in its second operative state and the disengagement between the cogwheel assemblies by means of a lateral displacement of the driven cogwheel assembly away from the key-actuated cogwheel assembly for a sequence of operations for changing the combination of an exemplary lock comprising three cogwheels in each cogwheel assembly.

Turning now to FIG. 11A, the lock 1 is shown with the key-actuated cogwheel assembly 43 in its second operative state. However, instead of the lock bolt 26 retracted into the lock bolt recess 62, the cogwheel assembly 59 is laterally moved away from the cogwheel assembly 43 as indicated by the arrow P by means of loosening of the screw 22 holding the spindle 63 and then sliding of the spindle 63, and therefore the cogwheel assembly 58, in the direction shown by the arrow from its position A to its position B.

Figure 11B:
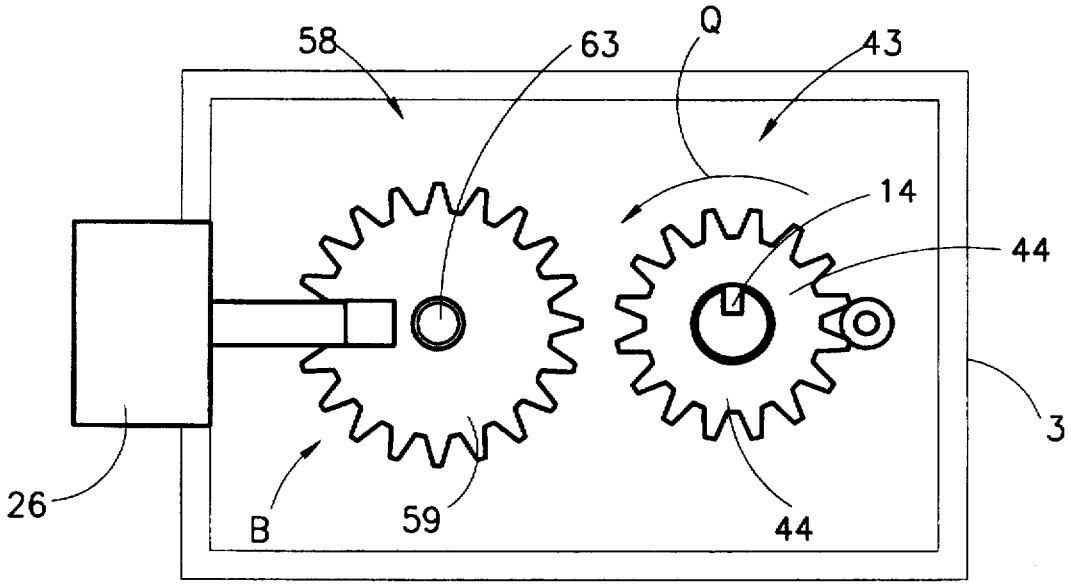
FIG. 11B illustrates the key-actuated cogwheel assembly in its first operative state enabling extraction of an old key and insertion of a new key for a sequence of operations for changing the combination of an exemplary lock comprising three cogwheels in each cogwheel assembly.

Turning now to FIG. 11B, once disengaged from one another, the cogwheel assembly 43 is returned to its first operative state by a counter clockwise turn of the old key 2 as indicated by the arrow Q which can then be extracted and replaced with a new key 2'.

Figure 11C:
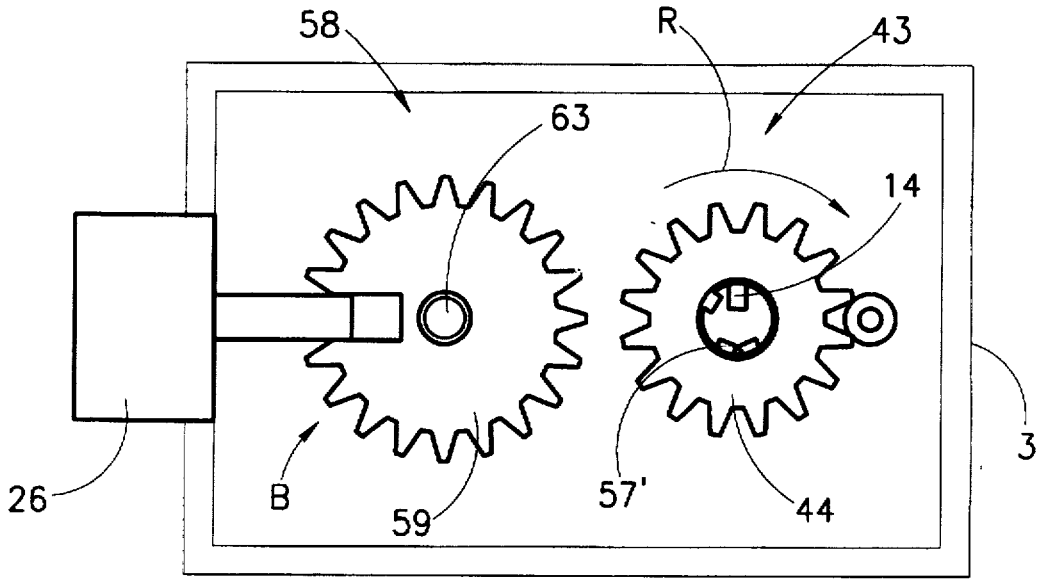
FIG. 11C illustrates the key-actuated assembly in its second operative state in which the cogwheels assume their indexed positions according to the combination of the new key for a sequence of operations for changing the combination of an exemplary lock comprising three cogwheels in each cogwheel assembly.

Turning now to FIG. 11C, the key 2' is rotated to the second operative state of the cogwheel assembly 43 as indicated by the arrow R in which each cogwheel takes up an indexed position determined by its corresponding coding bit 34' of the key 2' as evidenced by the indexed positions of the cogwheels 44 in FIG. 11C being different than the indexed positions of the cogwheels 44 in FIG. 11A.

Figure 11D:
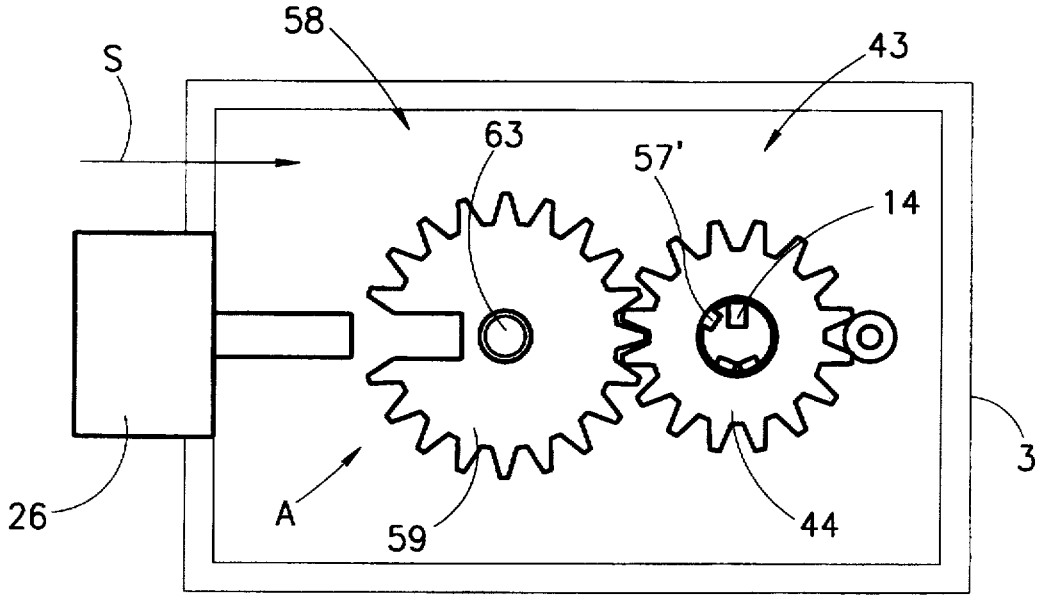
FIG. 11D illustrates the re-engagement between the two cogwheel assemblies by means of a lateral displacement of the driven cogwheel assembly towards the key-actuated cogwheel assembly for a sequence of operations for changing the combination of an exemplary lock comprising three cogwheels in each cogwheel assembly.

Thereafter, as shown in FIG. 11D, the cogwheel assembly 59 is returned to its position A as indicated by the arrow S so as to reengage the cogwheel assembly 43. The lock 1 is thereby coded with the combination of the key 2'.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A lock for use with a key having a stop bit and a series of radially projecting, axially spaced coding bits along a shank thereof, the stop bit and each coding bit having a leading edge and a trailing edge wherein the leading edges of the coding bits are staggered with respect to one another so as to provide for the coding of the key and the trailing edges of the stop bit and the coding bits are aligned so as to form one side of an axially extending groove, the lock comprising:

a) a housing having a keyhole with an inwardly directed radial key guiding pin and a lock bolt aperture;

b) a key-actuated cogwheel assembly having an axial rotary axis and comprising a series of cogwheels wherein each cogwheel has a central aperture in registration with the keyhole and further wherein each cogwheel has an inwardly directed radial key engagement projection and is axially spaced for engagement by the coding bits on insertion of the key into the housing;

c) a driven cogwheel assembly having an axial rotary axis and a series of cogwheels wherein each cogwheel has a slot and is axially spaced for meshing with a corresponding key-actuated cogwheel;

d) a lock bolt reciprocable between a retracted position and a projected position relative to the housing, the retracted and projected positions respectively corresponding to open and locked states of the lock; and e) a lock bolt actuating mechanism for reciprocating the lock bolt between retracted and projected positions wherein the key-actuated cogwheel assembly has a first operative state corresponding to the locked state of the lock attained when the trailing edge of the stop bit is stopped by the key guiding pin and each key-actuated cogwheel is urged by the trailing edge of a corresponding coding bit to a key insertion position in which a key engagement projection is in alignment with the key guiding pin so as to define an essential continuous ward of the lock, thereby enabling insertion of the key into the housing and extraction therefrom, and further wherein the key actuated cogwheel assembly has a second operative state attained when the leading edge of the stop bit is stopped by the key guiding pin and each driven cogwheel is turned by a corresponding key actuated cogwheel to a respective indexed position for effecting alignment of the slots so as to provide a lock bolt recess in registration with the lock bolt aperture, thereby enabling reciprocation of the lock bolt into and from the housing by the lock bolt actuating mechanism and inhibiting the extraction of the key from the housing.

2. The lock according to claim 1 wherein the key guiding pin projects further radially inward than the key engagement projections so as to prevent rotation of a partially inserted key.

3. The lock according to claim 1 wherein the lock bolt is biased to an outermost projected position in the lock's locked state.

4. The lock according to claim 1 wherein the lock bolt actuating mechanism is releasably stopped in a locking position by a stopping means.

5. The lock according to claim 1 wherein the lock bolt actuating mechanism is actuated by a second partial turn of the key on engagement thereby on an inward axial displacement of the key relative to the housing to disengage the key from the key actuated cogwheel assembly.

6. The lock according to claim 5 wherein the inward axial displacement of the key releases the stop bit stopping the lock bolt actuating mechanism in a locking position.

7. The lock according to claim 1 wherein the stop bit is spring loaded so as to bias the key outward with respect to the housing in the key-actuated cogwheel assembly's second operative state.

8. The lock according to claim 1 wherein the lock bolt actuating mechanism is coupled to the lock bolt with a resiliently flexible coupling.

9. The lock according to claim 1 further comprising:

an anti-lock picking mechanism preventing, on the one hand, the rotation of the cogwheels of the key actuated cogwheel assembly when an insertion force is applied to the lock bolt in the direction of the retraction of the lock bolt into the housing and, on the other hand, the forced insertion of the lock bolt into the housing when one or more of the cogwheels of the key-actuated cogwheel assembly is rotated.

10. The lock according to claim 9 further comprising:

a first member biased against the cogwheels of the key actuated cogwheel assembly so as to ride on the periphery thereof in a cyclic "in/out" motion and a second member having an end in close proximity to a trailing portion of the lock bolt wherein the second member is biased to a first operative position enabling the retraction of the lock bolt in the lock bolt recess when formed and has a second operative position inhibiting the retraction of the lock bolt in the lock bolt recess when formed and further wherein the first member and the second member are integrally coupled such that the end of the second member performs a cyclic "up/down" motion as the first member performs a cyclic "in/out" motion relative to the rotary axis of the key-actuated cogwheel assembly as it tracks the contour of cogs and troughs between adjacent cogs as the cogwheels of the key-actuated cogwheel assembly are turned.

11. The lock according to claim 1 wherein the driven cogwheel assembly is laterally displaceable relative to the key-actuated cogwheel assembly which is permanently mounted relative to the housing so as to be disengageable therefrom for enabling the re-coding of the combination of the lock.

12. A key for use with a lock, the key comprising:

a shank having a length defined between a first end and a second end; and a stop bit and a plurality of radially projecting axially spaced coding bits displaced along the shank between the first end and the second end, the stop bit and each coding bit peripherally projecting from the shank wherein the stop bit and each coding bit have a leading edge and a trailing edge wherein the leading edges of each of the coding bits are staggered with respect to one another and the trailing edges of the stop bit and each of the coding bits are aligned forming one side of an axially extending groove between the first end and the second end.

13. The key according to claim 12 further comprising:

a guide structure which cooperates with the key guiding pin such that a "full" clockwise or counter clockwise turn of a key is a two-step operation in which one step effects the transition of the key actuated cogwheel assembly between a first operative state and a second operative state and the other step effects the reciprocation of a lock bolt between a retracted opening position and a projected locking position.

* * * * *

UNITED STATES PATENT AND TRADEMARK OFFICE

CERTIFICATE OF CORRECTION

PATENT NO. :5,758,525

DATED :June 2, 1998

INVENTOR(S) :Goldman

It is certified that error appears in the above-identified patent and that said Letters Patent is hereby corrected as shown below:

On the title page, the following should be inserted after item [22]:
-- Foreign Application Priority Data
Sept. 1, 1995 [IL] Israel.....115124 --

Signed and Sealed this

Second Day of March, 1999

*Attest:*

Q. TODD DICKINSON

*Attesting Officer*

*Acting Commissioner of Patents and Trademarks*